US005871188A

United States Patent [19]

Lyle

[11] Patent Number: 5,871,188

[45] Date of Patent: Feb. 16, 1999

[54] COMBINATION WINCH AND WINCH MOUNTING BRACKET

[76] Inventor: Janet Lyle, 1351 McPherson, Council Bluffs, Iowa 51503

[21] Appl. No.: 727,038

[22] Filed: Oct. 8, 1996

[51] Int. Cl.[6] ..... A47B 96/06

[52] U.S. Cl. ..... 248/223.41; 248/220.22; 248/298.1; 242/404

[58] Field of Search ..... 248/223.41, 224.51, 248/224.61, 298.1, 300, 220.22, 223.21, 224.7, 201, 251, 262, 265, 257; 242/404, 399; 254/329

[56] References Cited

U.S. PATENT DOCUMENTS

| | | | |
|---|---|---|---|
| 965,658 | 7/1910 | Reubel | 248/223.41 |
| 1,720,309 | 7/1929 | Wakefield | 248/223.41 |
| 2,248,410 | 7/1941 | Moeller | 248/224.7 |
| 2,472,220 | 6/1949 | Lyon | 248/252 |
| 2,689,103 | 9/1954 | Ackerman | 248/257 |
| 3,135,489 | 6/1964 | Gledhill | 248/223 |
| 4,120,474 | 10/1978 | Hurley | 248/263 |
| 4,892,265 | 1/1990 | Cox | 248/223.41 |
| 5,174,542 | 12/1992 | DeLeeuw | 248/224.7 |
| 5,333,880 | 8/1994 | Allbright . | |
| 5,398,902 | 3/1995 | Crowe | 248/300 |
| 5,405,116 | 4/1995 | Shepherd et al. . | |
| 5,417,396 | 5/1995 | Merl . | |

*Primary Examiner*—Leslie A. Braun
*Assistant Examiner*—Gwendolyn Baxter
*Attorney, Agent, or Firm*—Terrance Siemens

[57] ABSTRACT

A two part bracket particularly suited for mounting a winch to a vertical environmental surface. One of the parts of the bracket is a base comprising a flat plate, with two bent edges, having chamfered screw holes for permanently mounting the base to a wall or other environmental surface. The base has three tabs projecting outwardly therefrom, thus forming a three sided pocket for receiving the second part. The second part includes a mounting flange cooperating with the three sided pocket, and a support plate projecting perpendicularly from the mounting flange. The support plate has a plurality of holes, some elongated, for receiving bolts or the like for fastening a winch to the bracket. The second part is manually removable from the base, and preferably remains with the winch to avoid inadvertent loss.

3 Claims, 2 Drawing Sheets

COMBINATION WINCH AND WINCH MOUNTING BRACKET

BACKGROUND OF THE INVENTION

1. Field of the Invention

The present invention relates to a bracket intended for mounting a winch for maintaining tension on a net of a tennis, volleyball, and badminton court to a supporting wall. The bracket has two components, a base for securing to the wall, and a support member having screw or bolt holes for receiving the winch. The support member is slidably retained within the base. Position of the winch on the support member can be adjusted.

2. Description of the Prior Art

Nets for certain sports, such as tennis, volleyball, badminton, and the like are usually maintained under tension during play by a winch. In courts specifically dedicated to such activities, a post solidly anchored in the ground or floor is typically provided to support the winch. However, some facilities are general purpose, or intended for many different activities. In these cases, the post usually cannot be provided, since it is not readily removable, and would interfere with some of the activities.

A representative tensioning system is shown in U.S. Pat. No. 5,333,880, issued to Edwin T. Allbright on Aug. 2, 1994. This patent points up problems in providing tensioning systems generally, notably space requirements and requirements for fasteners which must penetrate environmental surfaces. In the Allbright device, such fasteners include stakes driven into the ground.

This approach is appropriate in outdoor applications. However, it is occasionally desirable to erect nets indoors, such as in a gymnasium. Driving fasteners into wall or floor surfaces is usually objectionable as being unduly damaging to the gymnasium. There exists a need for a mounting, such as a bracket, adapted for indoor use.

Brackets for facilitating mounting of bulky or heavy items to vertical or horizontal surfaces have long been employed. Examples are seen in U.S. Pat. Nos. 5,405,116, issued to Charles G. Shepherd et al. on Apr. 11, 1995, and 5,417,396, issued to Milton J. Merl on May 23, 1995. These devices illustrate a number of aspects which are generally typical of brackets generally, such as holes for receiving fasteners. Merl illustrates multi-part construction. However, these devices are clearly different in construction from the present invention, which includes a permanently mounted base and a removable, complementing member having holes and slots for accepting threaded fasteners for securing the subject object.

None of the above inventions and patents, taken either singly or in combination, is seen to describe the instant invention as claimed.

SUMMARY OF THE INVENTION

The present invention sets forth a bracket which solves the problem of secure mounting of an item indoors. It is contemplated that a principal application of the invention is mounting sports nets to a vertical surface within a gymnasium of a school or similar public or semi-public institution. The gymnasium may see additional duty as a general meeting facility, or may accommodate sports activities other than those utilizing a net. Therefore, it is greatly desired that mounting of a winch not require undue disruption and be substantially removable.

At the same time, the mounting must be quite rugged. Nets impose a certain load upon their tensioning systems, including weight of the net and resistance to struck balls and to persons contacting the net. The net must potentially be maintained under tension for protracted periods of time.

To these ends, the novel bracket comprises a permanently mounted base of minimal bulk and obtrusiveness, and a manually inserted, manually removable complementing support member to which a winch or other object may be fastened. The base comprises a stout plate for mounting to a wall, folding partition, bleachers, or other environmental surface of the gymnasium, and has tabs for retaining the support member. The support member is configured to slide into engagement with the base, provide anchorage for a winch, and remain securely anchored even when tension of the winch is applied to the net.

The base has holes for accepting threaded fasteners such as screws and bolts. The selected surface may possibly be provided with permanent hardware such as anchors, or may possibly be drilled and perhaps tapped to accept threaded fasteners. Since the base is permanently mounted at its selected location, it is regarded as acceptable that a certain degree of work requiring skill and tools be necessary.

It is strongly desired, though, that subsequent installation and removal of the complementary supporting member be performed manually. This characteristic allows those lacking the skill of mechanics and access to tools to assemble the bracket while not surrendering secure mounting. This versatility is accommodated by configuration of the novel bracket. The base is further configured to accommodate minor inaccuracies in or misalignment of the base during initial installation which misalignment might allow the supporting member to disengage inadvertently. In other words, application of forces and vibration will not cause the support member to break free of the base.

The supporting member has provision for allowing bolting or similar attachment of a winch thereto. Since precise bolt patterns and the like cannot be predicted, the supporting member has provision for adjustable positioning of fasteners securing the winch in place on the supporting member.

It is possible to fasten the support member to a winch and leave the support member so attached. Whenever the winch is subsequently installed on the novel bracket, no further assembly requiring tools need be performed, the assembled winch and support member being capable of sliding engagement with the permanently mounted base. This practice has the further advantage of reducing likelihood of losing the support member, since it is permanently attached to its associated winch.

Accordingly, it is a principal object of the invention to provide a bracket suitable for securely mounting a winch to an environmental surface of a gymnasium.

It is another object of the invention that the novel bracket require tools and skilled construction procedures only during its initial installation at a selected site, and that subsequent assembly of the bracket not require tools.

It is a further object of the invention that the novel bracket include a permanently mounted component and a removable complementing component.

Still another object of the invention is that a permanently mounted component of the novel bracket be minimally obtrusive.

An additional object of the invention is to provide adjustability in accommodating a bolt pattern of a winch which is to be secured to the novel bracket.

It is again an object of the invention that the novel bracket accommodate minor misalignment in initially mounting the base of the novel bracket.

Yet another object of the invention is to retain the support member mounted to the winch intended to be mounted utilizing the novel bracket.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
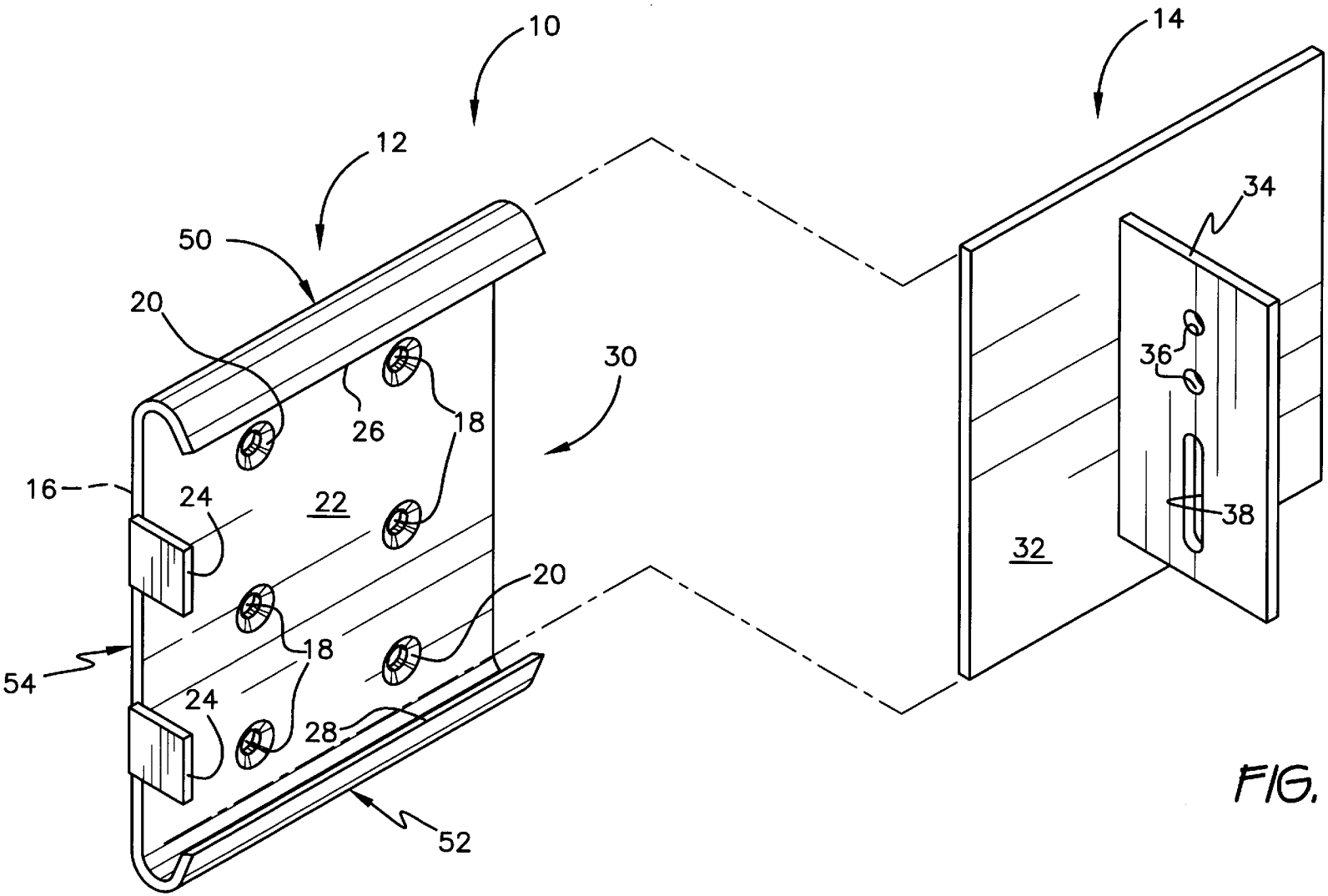
FIG. 1 is a frontal, exploded, perspective view of the invention.

FIG. 1 of the drawings illustrates construction of a preferred embodiment of the invention. Bracket 10 is seen to comprise two parts or separable components including a base 12 and a support member 14. Base 12 comprises a plate for abutting an environmental surface (see FIG. 2) to which an object, such as a winch 2 (see FIG. 2), is mounted. Base 12 has a contact surface 16 (see FIG. 2) which contacts the environmental surface to which base 12 is fastened, and has provision for mounting or fastening base 12 to the environmental surface. In the embodiment of FIG. 1, this provision includes six holes 18 each having a chamfered or countersunk outer surface 20. Flat headed screws (see FIG. 2) or similar fasteners pass through and seat in holes 18, with their heads being flush with the exposed outer surface 22 of base 12.

Figure 2:
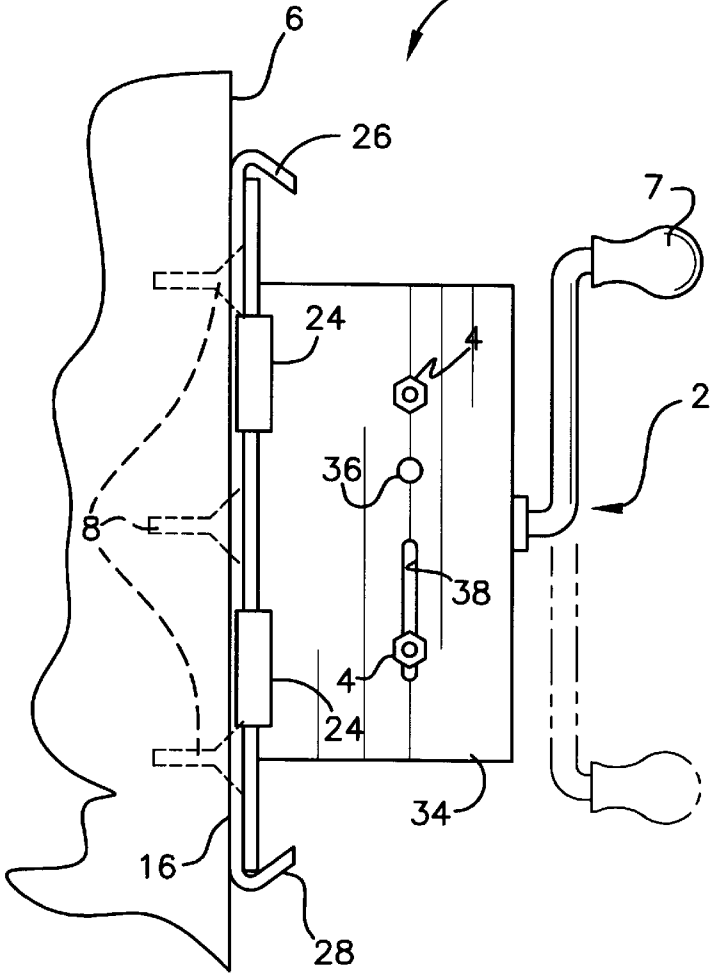
FIG. 2 is an environmental, front elevational view of the invention, drawn to reduced scale.

A plurality of tabs 24, 26, 28 project from base 12 in a direction opposite that of contact surface 16. Tabs 26 and 28 are located proximate edges 50, 52, respectively, and tabs 24 are located proximate the edge indicated at 54. Edges 50, 52 are located opposite one another on exposed outer surface 22 of base 12 which, in the embodiment described herein, is seen to be rectangular. Edge 54 from which tabs 24 extend, lies between edges 50 and 52. Tabs 24, 26, 28 are arranged to form a three sided pocket 30 for slidably receiving an engagement flange 32 of support member 14 which is inserted into pocket 30. Pocket 30 is three sided in that tabs 24, 26, 28 interfere with sliding egress from pocket 30 in three directions. Therefore, flange 32 can be slid into and out of pocket 30 from only one direction. Referring to FIG. 2, it can be seen that in the preferred embodiment tabs 26, 28 are generally inwardly curving.

The space enclosed by pocket 30 is dimensioned and configured to be just great enough to allow close cooperation, or sliding interfit, of flange 32. Orientation of this space will be considered to be parallel to surface 22 of base 12. Therefore, when base 12 is mounted to a flat environmental surface, pocket 30 is parallel to the environmental surface.

Support member 14 comprises both flange 32 for engaging pocket 30, and also a support plate 34 disposed perpendicularly to flange 32. Significance of this characteristic will be discussed hereinafter. Support plate 34 is securely fixed to and projects from flange 32.

Support plate 34 has structure for receiving shafts of threaded fasteners which are to be tightened to support plate 34. Preferably, this structure includes two holes 36 and an elongated hole 38.

FIG. 2 shows a winch 2 mounted to bracket 10 by bolts 4 (which will be understood to include nuts). Base 12 is secured to the surface of a wall 6. Flat headed screws 8 securing base 12 to wall 6 are shown in broken lines.

The purpose of perpendicular orientation of support plate 34 is readily understood when referring to FIG. 2. It will be seen that crank handle 7 of winch 2, when winch 2 is mounted to wall 6 by utilizing bracket 10, occupies a plane parallel to wall 6. Therefore, handle 7 can be turned or rotated without interfering with wall 6. Interference could ensue if the rotational axis of winch 2 were arranged other than perpendicular to wall 6. The arrangement of support plate 34, as set forth above, avoids this interference.

Figure 3:
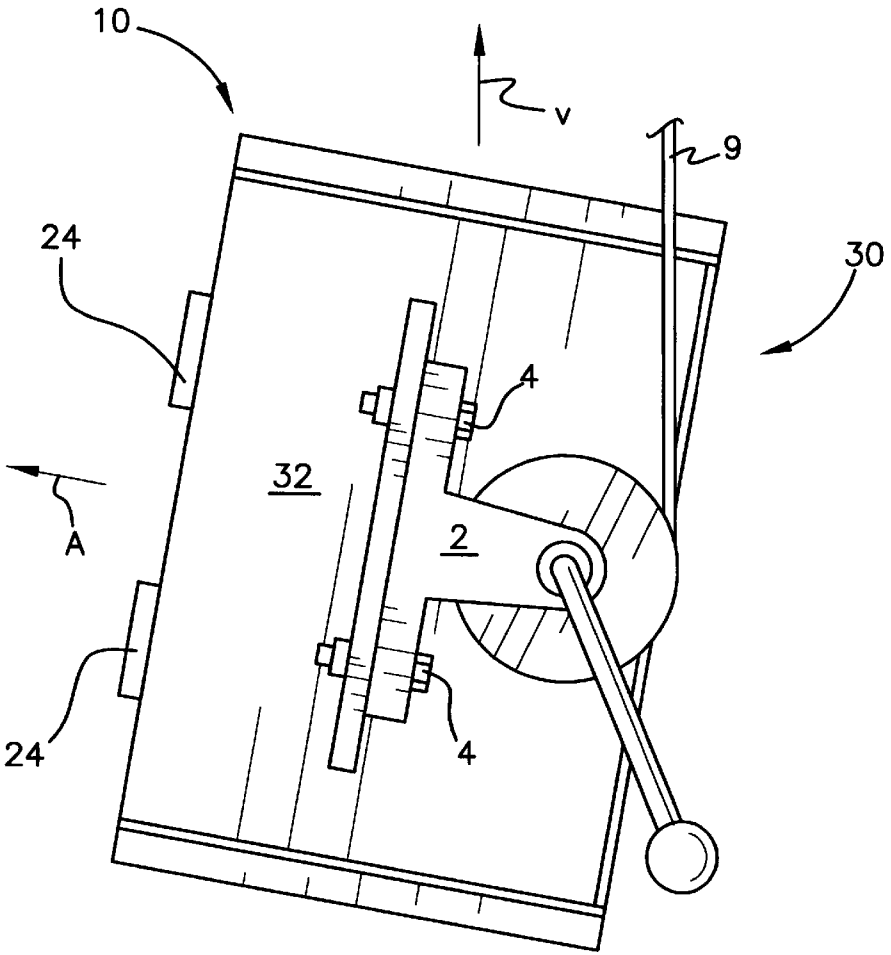
FIG. 3 is an environmental, side elevational view of the invention, drawn to reduced scale.

Referring now to FIG. 3, the advantage of the arrangement of holes 36 and 38 is discussed, and a preferred method of mounting bracket 10 is set forth. It is intended that bracket 10 be universally compatible with different winches. While winches for maintaining tension on sports nets (not shown) are generally similar, spacing or bolt pattern of bolts 4 cannot be predicted. Therefore, when mounting winch 2 to support plate 34, a bolt 4 is first passed through a selected hole 36 and secured by its associated nut. The remaining bolt 4 is then installed in elongated hole 38. Elongation of hole 38 provides adjustability, and therefore, reasonable assurance that almost all winches currently manufactured for maintaining tension on sports nets, and their different bolt patterns, will be accommodated by support plate 34.

In a preferred method of mounting, base 12 is oriented askew to a vertical direction indicated by arrow V. This assures that when tension is imposed upon cable 9 of winch 2, flange 32 will not be drawn out of engagement with pocket 30. Instead, when base 12 is mounted askew in the orientation depicted in FIG. 3, tension on cable 9 will have a tendency to draw flange 32 in the direction of arrow A. Interference with tabs 24 will then ensue, and escape of flange 32 and loss of securement of winch 2 is thus prevented.

It will occur to those of skill in the art that certain variations and modifications to the embodiment presented above may be made without departing from the spirit of the invention. Precise dimensions, configurations, and number of holes 18, 36, 38 and tabs 24, 26, 28 may be varied as desired. Chamfering of holes 18 may be omitted if pocket 30 is configured to provide additional space to accommodate resultant displacement of flange 32. Still other modifications may be introduced.

It is to be understood that the present invention is not limited to the embodiments described above, but encompasses any and all embodiments within the scope of the following claims.

I claim:

1. A bracket and winch for suspending a sports net from an environmental surface comprising:

a generally planar base for abutting a selected portion of the environmental surface, said planar base including a contact surface on a first side of said base for contacting the selected environmental surface;

mounting means for fastening said contact surface of said base to the selected environmental surface;

at least three tabs projecting from said generally planar base on a side opposite from said contact surface, said three tabs forming a three sided pocket on said generally planar base;

a generally planar support member including base engaging means dimensioned and configured to cooperate with said three sided pocket made up of said at least three tabs, this cooperation being such that said generally planar support member is held in a generally parallel relationship with said generally planar base when engaged therewith; and a support plate attached to said generally planar support member, said support plate being disposed perpendicular to said support member, said support plate further including means to removably attach a winch such that a handle of said winch is disposed in a generally parallel relationship to said base, said support member, and thus the environmental surface; whereby said planar base is semi-permanently attached to the environmental surface through said mounting means, said winch is attached to said support plate, and said planar support member can be quickly engaged or disengaged from said planar base to allow the quick setting up or taking down of a sports net.

2. The bracket and winch according to claim 1, wherein said winch has an associated cable extending in a desired direction and where said planar base is mounted to the environmental surface at an angle to the desired direction such that when said support member is engaged with said planar base and tension is put on the cable, said support member is urged into contact with said three sided pocket.

3. The bracket and winch according to claim 1 wherein said removable attachment means for said winch and said support plate comprise a plurality of apertures for receiving threaded fasteners and where at least one of said plurality of apertures is oversized for providing adjustability in accommodating different bolt patterns.

* * * * *